US009284930B2

(12) United States Patent
Harwood

(10) Patent No.: US 9,284,930 B2
(45) Date of Patent: Mar. 15, 2016

(54) HIGH PRESSURE PIEZOELECTRIC FUEL INJECTOR

(76) Inventor: Michael R. Harwood, New Market, AL (US)

( * ) Notice: Subject to any disclaimer, the term of this patent is extended or adjusted under 35 U.S.C. 154(b) by 872 days.

(21) Appl. No.: 13/487,183

(22) Filed: Jun. 2, 2012

(65) Prior Publication Data

US 2012/0305666 A1 Dec. 6, 2012

Related U.S. Application Data

(60) Provisional application No. 61/493,009, filed on Jun. 3, 2011.

(51) Int. Cl.

| | |
|---|---|
| ***F02M 57/02*** | (2006.01) |
| ***F02M 51/06*** | (2006.01) |
| ***F02M 59/46*** | (2006.01) |
| ***F02M 61/08*** | (2006.01) |
| ***F02M 69/04*** | (2006.01) |

(52) U.S. Cl.

CPC ..... *F02M 57/027* (2013.01); *F02M 51/0603* (2013.01); *F02M 59/464* (2013.01); *F02M 61/08* (2013.01); *F02M 69/041* (2013.01)

(58) Field of Classification Search

CPC ..... F02M 51/00–51/0696; F02M 57/027; F02M 59/464; F02M 61/08; F02M 69/041

USPC ..... 239/102.2, 533.2, 533.1, 584, 585.1

See application file for complete search history.

(56) References Cited

U.S. PATENT DOCUMENTS

| | | | | |
|---|---|---|---|---|
| 3,753,426 | A | 8/1973 | Lilley | 123/447 |
| 4,095,580 | A | 6/1978 | Murray et al. | 123/32 SJ |
| 4,531,541 | A | 7/1985 | Hartshorn | |
| 4,635,849 | A | 1/1987 | Igashira et al. | 239/102.2 |
| 4,649,886 | A | 3/1987 | Igashira et al. | 123/498 |
| 4,770,138 | A | 9/1988 | Onishi | 123/276 |
| 4,784,102 | A | 11/1988 | Igashira et al. | 123/447 |
| 4,939,405 | A | 7/1990 | Okuyama et al. | 310/330 |
| 4,958,610 | A | 9/1990 | Yamamoto et al. | 123/478 |
| 5,004,945 | A | 4/1991 | Tomita et al. | 310/328 |
| 5,130,598 | A | 7/1992 | Verheyen et al. | 310/316 |
| 5,271,362 | A | 12/1993 | Kobayashi et al. | 123/299 |

(Continued)

OTHER PUBLICATIONS

International Search Report and Written Opinion for related PCT application PCTUS1240635, filed Jun. 3, 2012.

(Continued)

*Primary Examiner* — Arthur O Hall
*Assistant Examiner* — Juan C Barrera
(74) *Attorney, Agent, or Firm* — James Richards

(57) ABSTRACT

A combined injector and fuel pump suitable for high pressure direct injection of heavy fuels into Diesel engines, in particular small light weight Diesel engines. The injector utilizes a piezoelectric actuator driving a piston assembly comprising an inlet reed check valve disposed thereon. The piston may house an injection needle valve component spring loaded against the piston on one end of the needle component and a valve seat on the other end of the needle component. Fuel enters an inlet port coupled to an inlet passage within the piston. Piezoelectric actuator contraction transfers fuel from the inlet passage through the reed valve to a pressurization chamber. Piezoelectric actuator expansion drives the piston to pressurize the fuel in the pressurization chamber, which forces open the needle valve and nozzle assembly, injecting a finely atomized mist of fuel into a cylinder. A poppet injection valve embodiment is described.

10 Claims, 19 Drawing Sheets

(56) References Cited

U.S. PATENT DOCUMENTS

| | | | | |
|---|---|---|---|---|
| 5,482,213 | A | 1/1996 | Matsusaka et al. | 239/584 |
| 5,740,782 | A | 4/1998 | Lowi, Jr. | 123/446 |
| 6,146,102 | A | 11/2000 | Otome et al. | 417/45 |
| 6,244,525 | B1 | 6/2001 | Gallup et al. | 239/533.12 |
| 6,279,842 | B1 | 8/2001 | Spain | 239/585.1 |
| 6,293,255 | B1 | 9/2001 | Otome et al. | 123/498 |
| 6,464,149 | B1 | 10/2002 | Hardy et al. | 239/102.2 |
| 6,520,423 | B1 | 2/2003 | Ricci-Ottati et al. | 239/89 |
| 6,568,602 | B1 | 5/2003 | Bram et al. | 239/5 |
| 6,760,212 | B2 | 7/2004 | Cheever, Jr. et al. | 361/160 |
| 6,772,963 | B2 | 8/2004 | Neretti et al. | 239/102.2 |
| 6,776,354 | B2 * | 8/2004 | Cooke | 239/102.2 |
| 7,073,730 | B2 * | 7/2006 | Haag et al. | 239/102.2 |
| 7,309,027 | B2 | 12/2007 | Magel et al. | 239/88 |
| 7,373,927 | B2 | 5/2008 | Vorbach | 123/499 |
| 7,431,220 | B2 * | 10/2008 | Kanne et al. | 239/102.2 |
| 7,438,050 | B2 | 10/2008 | Allen | 123/436 |
| 7,455,244 | B2 * | 11/2008 | Boecking | F02M 51/0603 239/102.2 |
| 7,464,689 | B2 | 12/2008 | Siewert | 123/299 |
| 7,484,673 | B2 * | 2/2009 | Boecking | F02M 45/04 239/102.2 |
| 7,533,655 | B2 | 5/2009 | Allen | 123/436 |
| 7,699,242 | B2 * | 4/2010 | Mochizuki | F02M 51/0603 239/102.2 |
| 7,721,716 | B1 | 5/2010 | Harwood | |
| 7,828,228 | B2 * | 11/2010 | Mochizuki | F02D 41/2096 239/102.2 |
| 7,931,211 | B2 * | 4/2011 | Yamamoto | F02M 61/12 239/102.2 |
| 8,100,349 | B2 * | 1/2012 | Matsumoto | F02M 51/0603 123/447 |
| 2005/0034707 | A1 | 2/2005 | Augustin | 123/446 |
| 2006/0186221 | A1 | 8/2006 | Heinz et al. | |
| 2007/0277784 | A1 | 12/2007 | Gibson et al. | |
| 2008/0184965 | A1 | 8/2008 | Allen | |
| 2009/0020101 | A1 | 1/2009 | Posselt et al. | 123/458 |
| 2009/0260599 | A1 | 10/2009 | Venkataraghavan et al. | 123/498 |
| 2010/0288239 | A1 | 11/2010 | Morris et al. | |

OTHER PUBLICATIONS

International Preliminary Report on Patentability Chapter II for related PCT application PCTUS1240635, filed Jun. 3, 2012.

* cited by examiner

Fig. 9C
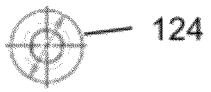
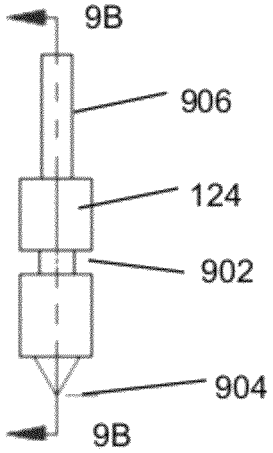
Fig. 9A
Fig. 9D
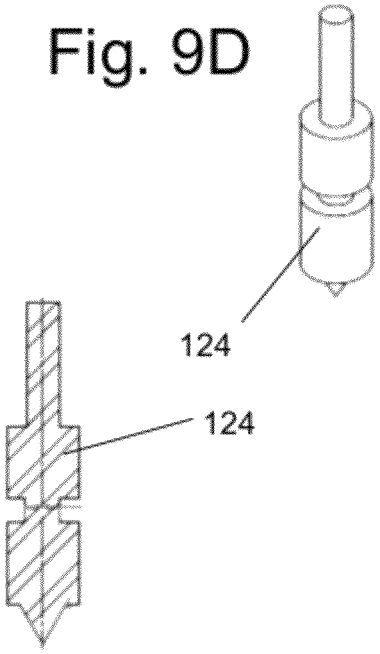
Fig. 9B

Fig. 10C
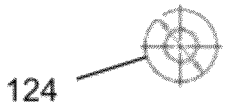
Fig. 10D
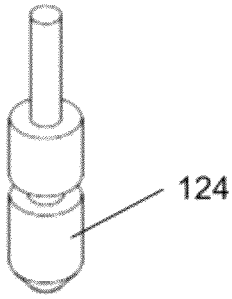
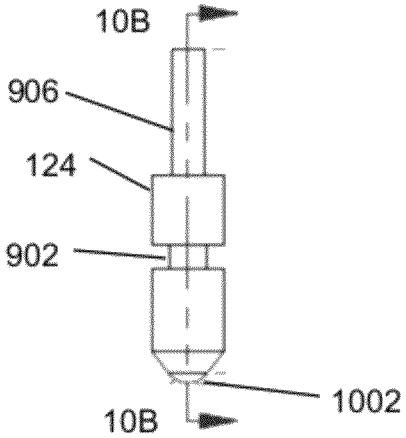
Fig. 10A
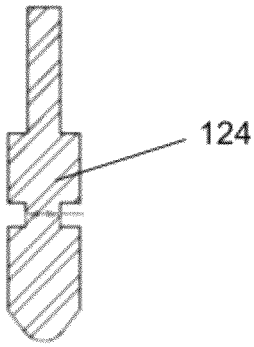
Fig. 10B

HIGH PRESSURE PIEZOELECTRIC FUEL INJECTOR

RELATED APPLICATIONS

This application claims the benefit of 35 USC 119(e) of provisional application 61/493,009, titled: "High Pressure Piezoelectric Fuel Injector", filed Jun. 3, 2011 by Harwood, which is incorporated herein by reference in its entirety.

FIELD OF THE INVENTION

The present invention pertains generally to the field of internal combustion engines, more particularly to the field of fuel injection systems for internal combustion engines.

RELATED APPLICATIONS

Related material may be found in U.S. Pat. No. 7,721,716 titled "High Pressure Piezoelectric Fuel Injector", filed Jul. 14, 2009 by Harwood, which is incorporated herein by reference in its entirety.

BACKGROUND OF THE INVENTION

Typical injectors for a Diesel engine operate in conjunction with a heavy, high pressure pump to operate the injector. The systems are well suited to the large diesel engines in trucking, automotive and marine service, however the systems scale poorly for smaller engines or where light weight is needed as in aircraft applications. As engine size decreases, the injectors and injector pump do not scale proportionately. The engine ends up with a significant fraction of the total weight invested in the injection system. Thus, there is a need for simple light weight injector systems and pump systems for small and light weight applications.

BRIEF DESCRIPTION OF THE INVENTION

Briefly, the present invention relates to a combined injector and fuel pump suitable for high pressure direct injection of heavy fuels into Diesel engines, in particular small light weight Diesel engines as may be used in small aircraft. The injector utilizes a piezoelectric actuator driving a piston assembly comprising an inlet reed check valve disposed thereon. The piston houses an injection needle valve component spring loaded against the piston on one end of the needle component and a valve seat on the other end of the needle component. Fuel enters an inlet port coupled to an inlet passage within the piston. Piezoelectric actuator contraction transfers fuel from the inlet passage through the reed valve to a pressurization chamber. Piezoelectric actuator expansion drives the piston to pressurize the fuel in the pressurization chamber, which forces open the needle valve and nozzle assembly, injecting a finely atomized mist of fuel into a cylinder. A poppet injection valve embodiment is described.

In one aspect of the invention, the piston/valve architecture is configured to achieve a small residual volume of fuel in the injection chamber to minimize the effect of the compressibility of the fuel.

In one aspect of the invention, the injector is adapted to receive fuel at low pressure, including gravity feed pressures.

In another aspect the injector may be adapted to deliver fuel by direct injection into a cylinder at high pressure during a combustion interval.

In another embodiment, the injector may be adapted to accurately deliver very low quantities of fuel per stroke.

In another aspect of the invention, the output valve and injector spray nozzle features are integrated into the same structure and utilize the same components.

In another aspect of the invention, the injector may direct the spray pattern at any desired angle with respect to a plane perpendicular to the injector axis.

In a further feature of the invention, the nozzle generates fine atomization without requiring protrusions into the combustion chamber that tend to collect carbon deposits.

In a further feature, the nozzle presents a substantially flush and rugged face to the combustion chamber for minimum combustion gas flow disturbance and minimum deposit buildup.

In a further feature of the invention, the injector directly injects fuel at a desired angle into the cylinder, avoiding protrusions within the cylinder subject to carbon deposit buildup.

In a further aspect of the invention, the actuator length dimension is coupled to the piston to move the piston to compress a volume of fuel to cause injection. In one embodiment, the width dimension is decoupled from the fluid by a close fitting piston or by O-rings or other sealants.

In a further aspect of the invention, the actuator is coupled to the piston by an axial coupling having rotational decoupling to minimize torque transmitted to the actuator, for example, a flexible coupling, a spherical dome coupling, a contact coupling. The coupling may be spring loaded to provide return motion.

In a further aspect of the invention, the actuator is coupled to the piston with one mating surface being flat and the other being domed to allow misalignments and assure center loading on the actuator.

In a further embodiment, the input reed valve seat includes small holes for fuel transfer. The holes should be small enough so that full pressure on the reed does not flex the reed enough across the span of the hole under maximum peak pressure to cause long term fatigue concerns in the reed. Standard stress strain analysis may be used to determine the strain, which is then compared with known fatigue properties for the reed material.

In a further aspect of the invention, the input reed valve may be an arc section leaf spring operable on the outer perimeter of the face of the piston.

In one aspect of the invention the injector may utilize a needle valve supported by the piston and retracting into the piston to open and release fuel.

In an alternative aspect of the invention, the injector may utilize a poppet valve that is pushed into the engine cylinder to open and release fuel.

In one aspect of the invention, the needle valve may be fabricated with a soft material, for example brass, copper, delrin, or glass filled delrin. The needle valve seat may be a hard metal, for example steel and may be a conical bevel or may be a sharp edge. The sharp edge needle valve seat may be treated by staking with a precision ground hard metal conical needle pressed with a light force to ensure a precise round shape free of burrs and slightly round the edge of the sharp seat.

The injector may include various nozzle styles. In particular, the needle valve allows coupling to compact nozzle structures formed in or attached to the valve seat partition wall. One alternative may include a valve covered orifice. One orifice structure may comprise a plurality of holes in the range of 0.002 to 0.003 inch diameter with a 2.5 length to diameter ratio. The holes may optionally open to a conical expansion opening to the engine cylinder space.

In further variations, the cylinder head surface may be conformal to the piston valve and valve holder structure, permitting only a slight clearance on the order of, for example, less than 0.009 inch, (0.25 mm) for movement of the fuel.

In one variation, an equivalent cylindrical depth (based on total volume) of the compression chamber may be less than 1/10 of the diameter, preferably less than 1/20 of the diameter, more preferably less than 1/50 of the diameter.

In one variation, the compression chamber volume may be configured for a volume such that compression of the fuel accounts for less than half of the piston movement, preferably less than 20%, more preferably less than 10%.

In a further variation, the piston has a flange extending beyond an operative fluid pressurization diameter of the piston and the piston is preloaded against said piezoelectric element by at least one spring in operative contact with the flange.

In a further variation, a compact integrated assembly is formed comprising a cylinder, cylinder head and a injection valve seat, and injection nozzle orifice fabricated in a single piece of material.

Further features of the invention relate to methods of making and methods of using the fuel injector based on the features described herein.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 9A-FIG. 9D illustrate an exemplary conical needle valve for the injector of FIG. 2 or FIG. 5.

FIG. 10A-FIG. 10D illustrate an exemplary spherical point needle valve for the injector of FIG. 2 or FIG. 5.

FIG. 13 also shows the locating rods for the reed valve shown in FIG. 8, which is also used in other fuel injector embodiments.

DETAILED DESCRIPTION OF EXEMPLARY EMBODIMENTS OF THE INVENTION

Figure 1:
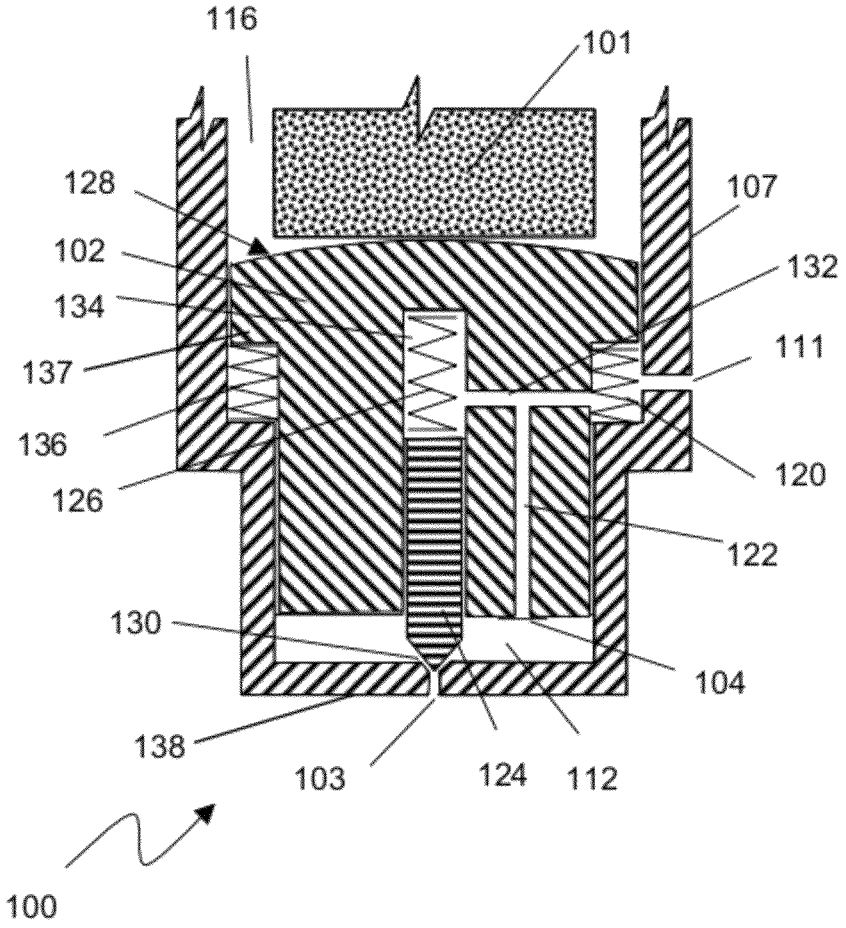
FIG. 1 depicts a cross section view of an exemplary high pressure piezoelectric actuated impulse pump and fuel injector in accordance with the present invention.

The injector of the present invention eliminates the need for large, heavy high-pressure fuel pumps while maintaining the fine atomization consistent with the needs of state-of-the-art direct fuel injection systems. The high pressure necessary for the fine atomization is produced by a piezoelectric actuator driven piston. Piezoelectric actuators are found to be exceptionally well suited for very small heavy fuel (VSHF) engine injectors. Piezoelectric actuators may also be referred to as piezoelectric transducers, or PZT's. While the actuation distance of piezoelectric actuators is often small (10-100 micrometers (μm)), the injection volume of injectors designed for very small (i.e. ~20 cubic centimeters (cc)) engines is also very small 1 to 2 cubic millimeters (1-2 $mm^3$), typically, but not limited to less than three cubic millimeters per stroke at maximum power output. In addition, the piezoelectric actuator is adapted to produce relatively large forces in a compact package, and consequently, are able to create high pressures on the order of three thousand psi (207 bar) (1 bar=100 kPa) consistent with the needs of a Diesel engine. Exemplary piezo actuators may include P-841.20 and P-888.9 manufactured by Physik Instrumente. The present invention eliminates the need for a separate high pressure pump by the use of piezoelectric actuators as a driver for a compact high pressure impulse pump integrated with an injector nozzle assembly.

The present invention is an enabling technology for small engines burning heavy fuels. A plunger pressurization mechanism is built into the injector itself eliminating the high-pressure fuel pump typical of most diesel injection systems, while maintaining the atomization consistent with state-of-art injectors. A piezoelectric actuator is used to both provide a compact pressurization mechanism and rapid, precision control of the injection pulse to ensure that the proper amount of fuel is injected at the proper time.

In one aspect of the invention, the invention permits a very small residual volume of fuel in the injection chamber to minimize the effect of the compressibility of the fuel. Typical hydrocarbon fuel oil has a bulk elastic modulus on the order of 1.5 to $2.5\times10^5$ psi, $lbf/in^2$ (1 to $1.7\times10^9$ Pa, $N/m^2$). Thus, a sample of fuel might compress 0.5% for 1000 psi (69 bar) compression. For 100 microns of piston deflection, a sample of fuel 20 mm in depth would compress 100 microns, absorbing the entire piston stroke in compression, even if no fuel is delivered to the nozzle. This becomes 7 mm depth to develop 3000 psi from 100 micron piston movement, or 0.7 mm if the piston only moves 10 microns. Thus, it is desirable to minimize the volume of fuel in the compression chamber. Several features of the present invention permit a very small residual volume. In particular, the needle injection valve is housed within the piston and operated by injection pressure. This allows the piston to operate very close to the end of the cylinder. In addition, the inlet reed valve is mounted on the piston. The reed valve is a disk with narrowly etched or machined cuts such that the disk occupies substantially all (>90%) of the cylinder volume for the thickness (0.005 inch) occupied by the disk, leaving little stray fuel volume in that thickness. The cylinder head surface may be conformal to the piston valve and valve holder structure, permitting only a slight clearance on the order of, for example, less than 0.009 inch, (0.25 mm) for movement of the fuel. In one variation, an equivalent cylindrical depth (based on total volume) of the compression chamber may be less than 1/10 of the diameter, preferably less than 1/20 of the diameter, more preferably less than 1/50 of the diameter, more preferably less than 1/200 of the diameter. In one variation, the compression chamber volume may be configured for a volume such that compression of the fuel accounts for less than half of the piston movement, preferably less than 20%, more preferably less than 10%, more preferably less than 5%.

Figure 12:
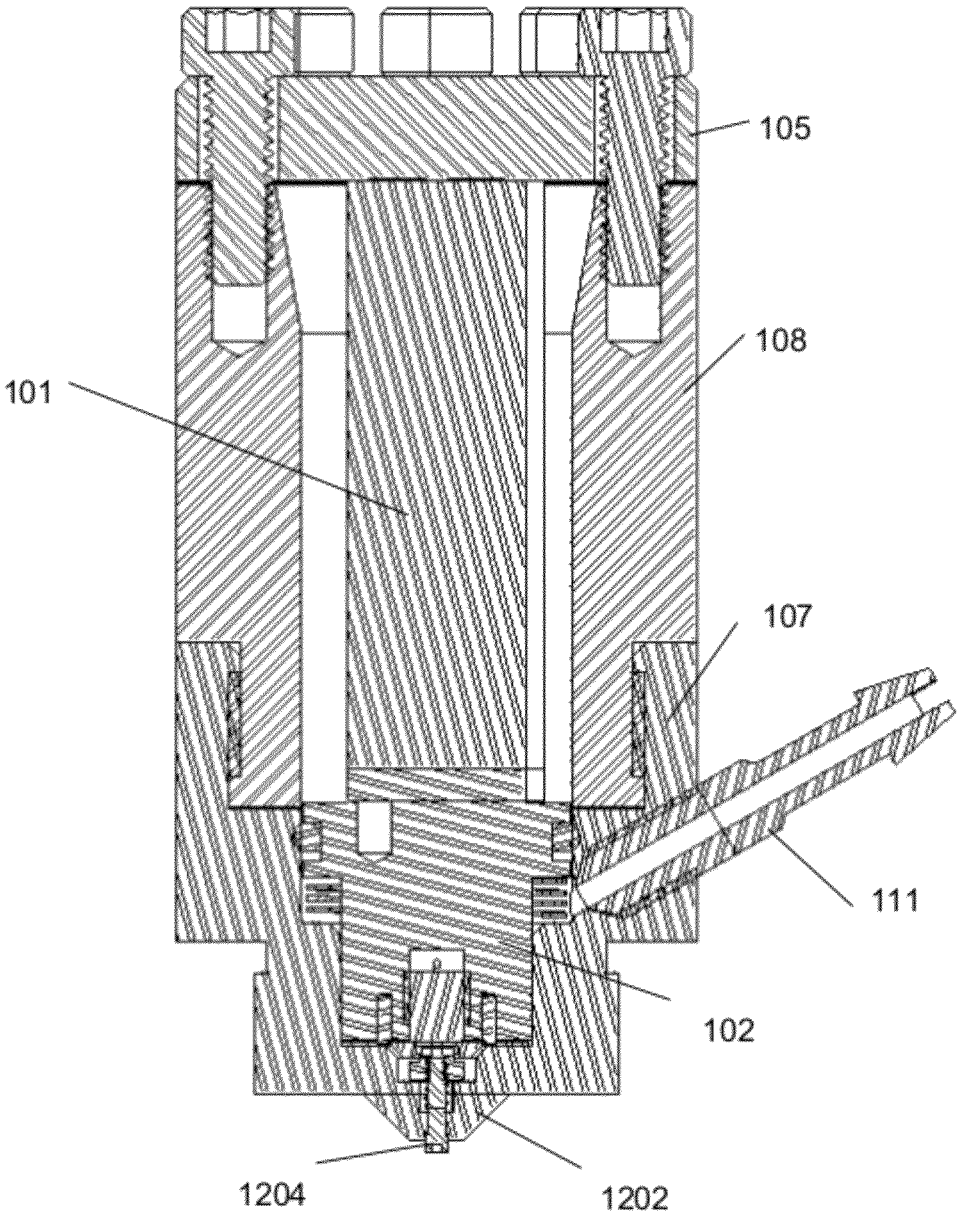
FIG. 12 illustrates a cross section view of an exemplary high pressure piezoelectric actuated impulse pump and fuel injector having a poppet valve.
Figure 13:
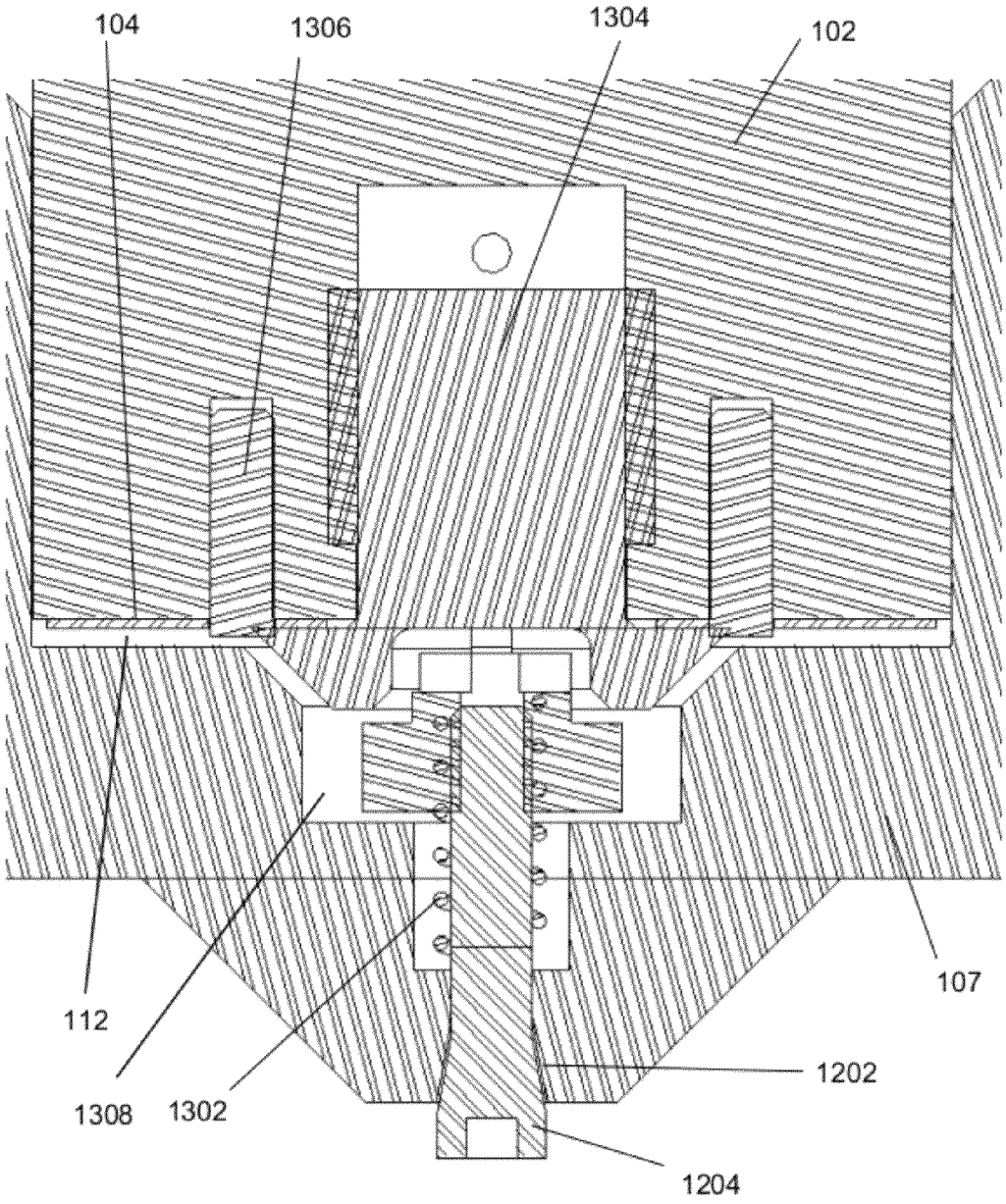
FIG. 13 illustrates a close-up view of the piston and injection valve of FIG. 12.

Various exemplary variations are shown in the figures. A first variation shown in FIG. 1 and FIG. 2, which illustrate a needle valve injection nozzle combination. The second variation, shown in FIG. 12 and FIG. 13 illustrate a poppet valve injector nozzle combination. The detailed variations will now be described with respect to the drawings.

Figure 2:
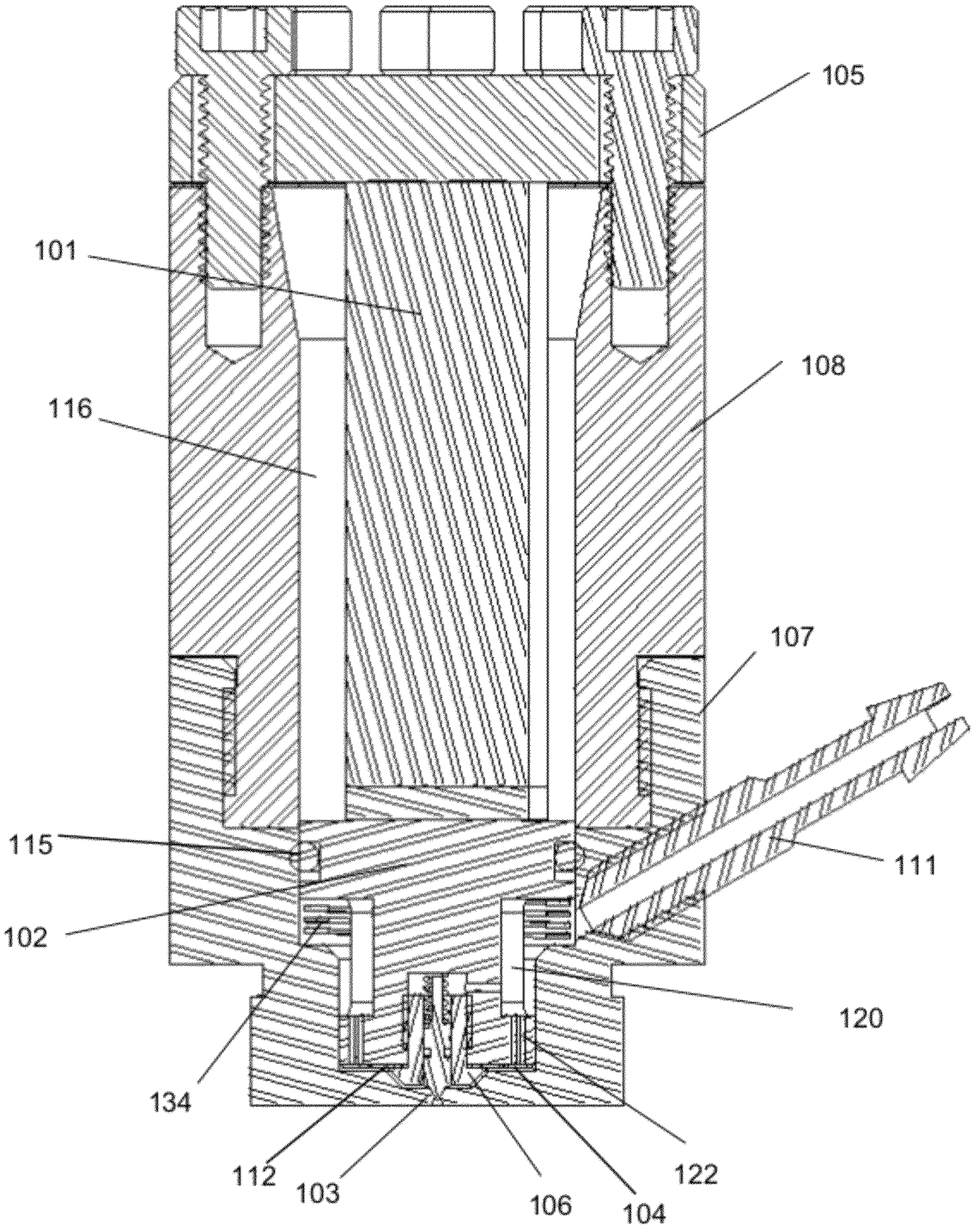
FIG. 2 illustrates a cross section view of an exemplary high pressure piezoelectric actuated impulse pump and fuel injector in accordance with the present invention.
Figure 3:
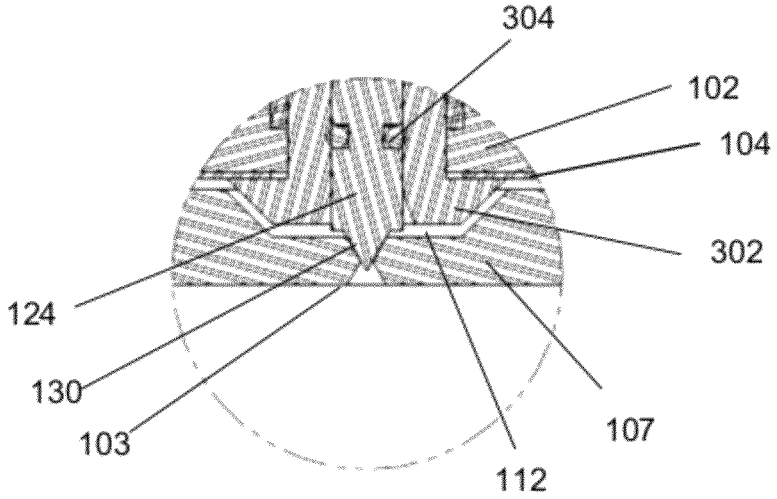
FIG. 3 illustrates a close-up of the lower piston and needle valve of FIG. 2.
Figure 4:
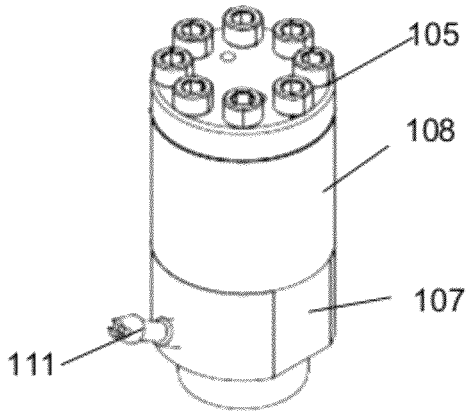
FIG. 4 illustrates a perspective view of the injector of FIG. 2.

FIG. 1 and FIG. 2 illustrate a cross section view of an exemplary high pressure piezoelectric actuated impulse pump and fuel injector in accordance with the present invention. FIG. 3 illustrates a close-up of the lower piston and needle valve of FIG. 2. FIG. 4 illustrates a perspective view of the injector of FIG. 2.

Referring to FIG. 1 and FIG. 2, the fuel injector comprises a piezoelectric actuator 101 driving a piston 102 to pressurize fuel in a pressurization chamber 112, forcing the fuel through a needle valve nozzle structure 103 to be injected into an engine cylinder. The pressurization chamber 112 contains the volume of fuel compressed by the piston and is bounded by, at least, the piston, the cylinder walls, and the cylinder head 138. In one variation, the cylinder walls and cylinder head may be fabricated as a single piece. The piston houses an injection needle valve component 124 spring loaded with a needle spring 126 against the piston 102 on one end of the needle component 124 and against a valve seat 130 on the other end of the needle component 124. The piezo actuator 101 and piston 102 are fitted within a bore within a housing 108. The housing may be constructed of several casings as is convenient for assembly or repair. As shown in FIG. 1 the housing comprises a nozzle casing 107 having an input port 111 and a precision bore closely matching the piston 102 while allowing free movement of the piston 102. The main casing 108 is fitted with an end cap 105. The main casing 108, or alternatively, the end cap 105 may include a cable for electrical connection to the piezo actuator 101. On the lower end, the main casing 108 is threadably attached to a nozzle casing 107 carrying the nozzle assembly.

FIG. 1 illustrates a single input port 111 in accordance with one variation of the invention. Alternatively, the input chamber 120 may have two ports, one on each side of the main body, for flow through capability to aid in purging air in the input chamber to prime the injector. As a further alternative, the injector system may include a low pressure pump (less than 30 psi) to keep the injector supplied with fuel. In a further alternative, the injector system may include an intermediate pressure pump (greater than 30 psi) to permit the use of a stiffer spring constant on the input reed valve 104.

FIG. 2 illustrates a cross section view of an exemplary high pressure piezoelectric actuated impulse pump and fuel injector in accordance with the present invention showing additional detail.

Referring to FIG. 2, the piston 102 operates within a matching bore in the nozzle casing 107. The piston 102 is aligned with the input port 111 to allow fuel to pass to the input chamber 120 and fuel flow passages 122 through the piston 102. The piston 102 has a reed valve 104 attached to the pressure face (bottom face) of the piston. The piston has one or more passages 122 around the periphery of the piston 102 to allow the fuel to pass from the input chamber 120 through the piston 102, between the piston face and the reed valve 104 and into a pressurization chamber 112 below the piston 102. The reed valve 104 is held by a reed clamp 106, also referred to as a piston insert 106. The reed valve 104 presents a very light captive force holding the reed 104 in contact with the face of the piston 102. The light captive force permits opening of the reed valve by a slight pressure difference between the input pressure and the pressure of the pressurization chamber. When injecting fuel, however, the reed valve has to withstand pressure differences of up to 3000 psi, (207 bar) or more, has to operate in tens of microseconds and has to have a near zero on to off state displacement because of the very small movement of the piezo actuator. In a further variation, the input reed valve may be an arc section leaf spring operable on the outer perimeter of the face of the piston. FIG. 2 shows an arc section leaf spring reed valve. The spring cover may be etched from a disc of spring material. A spring arm covers the inlet hole in the piston. A center hole allows for the needle component.

The piston is preferably a strong, tough, light, corrosion resistant material. Depending on pressure required, steel, stainless steel, titanium, and even aluminum alloys or other materials may be found suitable. As shown in FIG. 1A, the piston is a precision fit to the bore and may operate without rings or seals. A precision fit of, for example, 0.001 inch (0.025 mm), or less, preferably 0.0004 inch relative to the diameter is desirable. Alternatively, O-rings or other sealant techniques may be applied. In particular, an O-ring may be placed above the input port between the piston and casing at location 115 indicated in FIG. 2. The space 116 between the actuator and casing is preferably maintained free of fuel and preferably contains air to prevent interference with width variations in the actuator that may be associated with length variations used to drive the piston. To prevent gradual filling with fuel, the space 116 may be vented to drain any fuel leakage into space 116.

In one variation, the top of the piston 102 has a curved face 128 (FIG. 1) to mate with a flat face of the piezo element 101 to allow for mounting tolerances and to assure center axis loading of the peizo element, as these elements may be easy to fracture if loaded off axis. Alternatively, the piezo may be domed and the piston flat or both domed.

The piston may be spring loaded to maintain coupling to the piezo actuator. A piston spring 136 is shown. In one variation, the piston spring 136 may be a Bellville spring. The piston may have a flange 137 extending beyond an operative fluid pressurization diameter of the piston and the piston is preloaded against the piezoelectric element by at least one spring 136 in operative contact with the flange 137.

The piston includes a bore for receiving and housing a needle component 124 for the injection needle valve. The needle component 124 is spring loaded 126 against the piston 102. The spring loading forces the piston in contact against the piezo transducer and forces the needle component in contact against the needle valve seat 130 in the lower housing. The upper chamber of the bore houses the needle valve spring 126 and is vented through a vent passage 132 to the low pressure fuel input line. Alternatively, the needle bore may be vented to another low pressure location (not shown). The needle moves freely without friction in the piston bore and should fit closely to minimize leakage contributing to pressure loss during a power pulse. In an alternative variation, the needle may be sealed with an O-ring or other seal.

FIG. 3 illustrates a close-up of the lower piston and needle valve of FIG. 2. FIG. 3 shows greater detail in the needle valve 124, valve seat 130, piston insert 302, needle valve O-ring 304 and reed valve 104. FIG. 3 also shows an exemplary conical expansion nozzle 103. Note the very thin section pressurization chamber 112.

Figure 5:
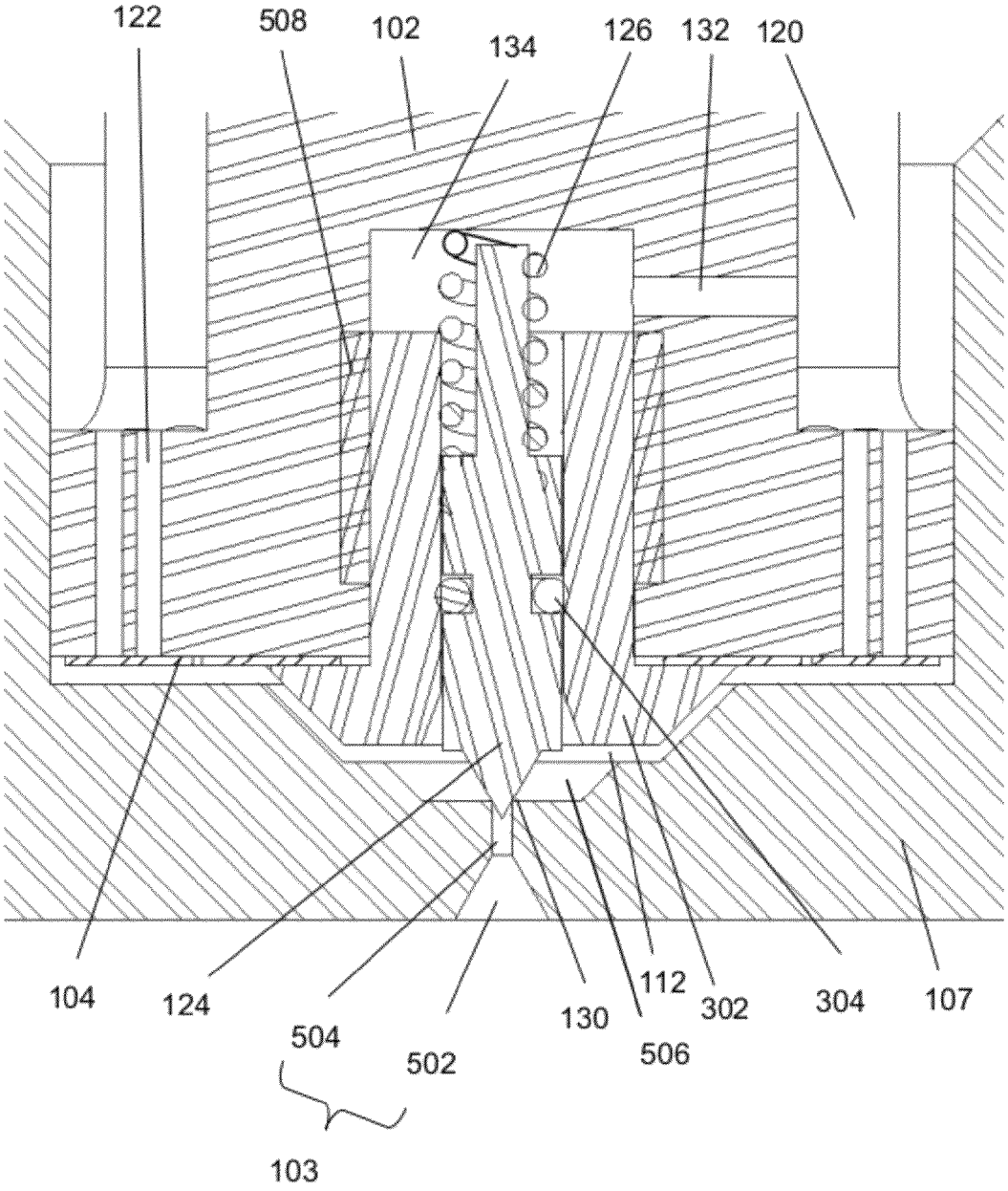
FIG. 5 illustrates the detail of the lower piston and valve of a variation of the injector of FIG. 2 having a sharp corner, non beveled, valve seat.

The needle valve 124 operates in response to pressure from the injection pulse. Fluid pressure in the pressurization chamber 112 forces the needle component 124 into the piston 102, lifting the needle component 124 from the valve seat 130 and allowing fluid through the valve and into the engine cylinder. The needle valve tip may be conical or may be spherical. A conical angle of 45 degrees from center line should work in many applications. The needle valve seat may be conical or may be a straight hole with a sharp edge. FIG. 1, FIG. 2, and FIG. 3 show a conical valve seat 130. FIG. 5 shows a sharp edge valve seat 130.

The lower casing 107 is alternatively referred to as the nozzle casing 107 as this casing includes the nozzle assembly. By virtue of the valve architecture, the pressurization chamber may be made extremely small in volume. A small volume is preferred to minimize compressibility of the fluid, which may contribute to reduced pressure and reduced output from a given size peizo element. Piezo element displacement is extremely small, so losses from compressibility of the fluid may be significant. The valve architecture allows shrinking the pressurization chamber thickness to one millimeter or less, greatly reducing fluid volume and resulting compression loss.

The needle valve feeds a nozzle structure 103. Since the needle valve structure is contained within the injector, a variety of nozzle structures may be coupled to the injector output. The nozzle structure may include one or more holes and may include expansion cones associated with the holes as will be described in greater detail later.

The high velocity flow through the nozzle results in very fine atomization of the fuel. The Sauter Mean Diameter (SMD) of the fuel droplets is calculated to be on the order of tens of micrometers.

While there are many competing correlations for SMD, one correlation available in literature is provided below.

$$SMD = .0217D[Re]^{0.25}[We]^{-0.32}\left[\frac{\mu_l}{\mu_g}\right]^{0.37}\left[\frac{\rho_l}{\rho_g}\right]^{0.32}$$

where,

D is the diameter of the orifice in meters

Re is the Reynolds number

We is the Weber number $\mu_l$ is the absolute viscosity of the fuel in Newton—seconds per square meter $\mu_g$ is the absolute viscosity of the gas in Newton—seconds per square meter $\rho_l$ is the density of the liquid in kilograms per cubic meter $\rho_g$ is the density of the gas in kilograms per cubic meter Using Exemplary Values:

$$SMD = .0217(50.8\times10^{-6})[3152]^{0.25}[12508]^{-0.32}\left[\frac{1.2\times10^{-3}}{1.8e\times10^{-5}}\right]^{0.37}\left[\frac{804}{1.22}\right]^{0.32}$$

$$SMD = 15.7\ \mu m$$

In operation, in accordance with one exemplary embodiment, the drive circuit for the piezo actuator is initially at zero volts with the actuator at rest. The input chamber and pressurization chamber are filled with fuel at equilibrium pressure between the input chamber and pressurization chamber and the reed valve is closed. When an injection is initiated, an electrical drive pulse is sent to the actuator causing the actuator to expand. The expansion is small, but very rapid. Typical piezo devices may expand by 1/1000 of the length at maximum drive voltage. Thus, a piezo may expand on the order of, for example, 100 microns (0.1 millimeter) in, for example, 100 microseconds. The pulse is generated as a function of the rising slope of the drive pulse together with the response of the actuator and associated mechanics. The injection may be complete in, for example, 100 microseconds. The drive pulse may continue to hold the drive voltage high as the injection completes. The pulse may be complete in, for example, 100 microseconds and the piezo driver then drops the voltage to the piezo driver according to a desired voltage drop profile. Since the piezo driver has less tensile strength than compressive strength, it is desirable to reduce the voltage at a slower rate than the expansion rate to minimize tensile stress on the actuator. The relaxation of the actuator generates a relative vacuum in the pressurization chamber which opens the input reed valve and allows the fuel to refill the pressurization chamber for a return to the initial at rest conditions. Alternative electrical drive states may include a positive and negative voltage state for compression and expansion or other drive states as appropriate for the chosen piezoelectric material and configuration.

Referring to FIG. 2 and FIG. 5, beginning with the actuator relaxed at the end of the recharge phase, the reed valve is closed and the piston is moved upward by, for example, 100 microns ready for an injection pulse. When the injection pulse is triggered, the actuator expands by 100 microns pushing the piston down and pressurizing the fuel in the pressurization chamber. The high pressure closes the input reed valve tightly and holds the valve closed. The pressurized fuel lifts the needle valve 124 allowing fuel to flow from the pressurization chamber through the exit passage to the nozzle structure 103. The fuel is then ejected into the engine cylinder at a high velocity. When the needle element 124 of the needle valve is lifted, the needle element retracts into the piston assembly 102. The piston assembly has a retraction chamber 134 to allow for this retraction. The retraction chamber 134 houses a needle valve spring 126 acting against the piston 102 to provide a predetermined force to keep the needle valve normally closed against the valve seat 130. The retraction chamber is provided with a vent passage 132 to a low pressure space. As shown the low pressure is the input fuel chamber 120. The needle element of the needle valve is optionally provided with an O-ring seal 304 to minimize leakage that would reduce the performance and output of the injection pulse.

At the end of the 100 microsecond injection pulse phase, the injection valve closes. The drive voltage then decays, allowing the piezo actuator to return to the relaxed length. As the piston moves upward, the input reed valve opens due to partial vacuum in the compression chamber combined with any pressure available in the input chamber. Fuel then flows to fill the pressurization chamber until equilibrium is established, at which point, spring forces in the reed valve close the reed valve and the process repeats again for the next injection pulse.

In a further advantage of the position of the reed valve on the piston, the reed valve is positioned so that the inertia of the reed valve works to enhance the operation of the reed valve. As the piston accelerates downward to compress the compression volume 112, the inertia of the mass of the reed valve presses the reed valve against the piston, closing and sealing the reed valve. Thus, the inertia of the reed valve works to enhance the closing pressure provided by the back pressure of the pressurized volume 112. When the piston accelerates upward, the inertia of the reed valve acts to open the reed valve, enhancing the action provided by the pressure differential between the input chamber and pressurization chamber and increasing the fuel flow into the pressurization chamber.

FIG. 5 illustrates the detail of the lower piston and valve of a variation of the injector of FIG. 2 having a sharp corner, non beveled, valve seat. FIG. 5 shows a straight through hole 504 from the pressurization chamber to the engine cylinder. The injection hole feeds an expansion cone 502 to allow expansion of the fuel while maintaining substantial thickness of the injector wall for maximum stiffness.

The needle valve 124 may be fabricated with a soft material, for example brass, copper, delrin, or glass filled delrin. The needle valve seat 130 may be a hard metal, for example steel and may be a conical bevel or may be a sharp edge. The sharp edge needle valve seat may be treated by staking with a precision ground hard metal conical needle pressed with a light force to ensure a precise round shape free of burrs and slightly round the edge of the sharp seat. In one alternative the valve insert 302 may be press fit into the piston 102. Alternatively, the valve insert maybe threaded as indicated in a region 508 for threads.

FIG. 5 also shows a transition chamber 506, part of the pressurization chamber 112, the transition chamber 506 is thicker than the remainder of the pressurization chamber 112 to allow collection of the fluid flow before entering the nozzle 103. The transition chamber should be less than 50%, preferably less than 20%, more preferably less than 10% of the total pressurization chamber volume to minimize compressibility of the fluid.

Figure 6:
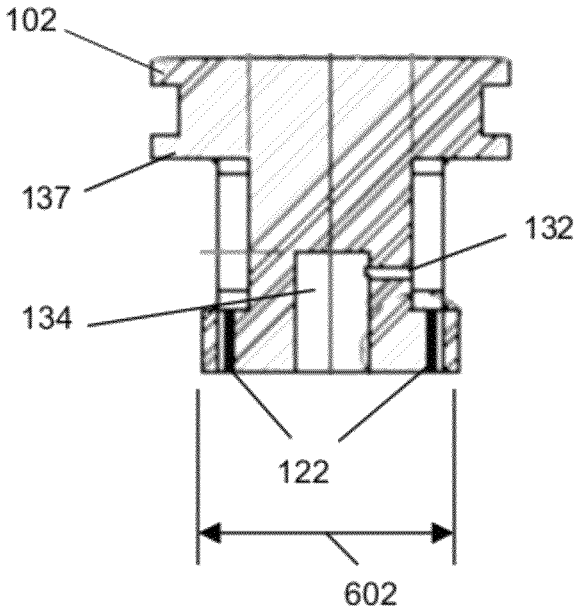
FIG. 6 illustrates the piston of the injector of FIG. 2.

FIG. 6 illustrates the piston of the injector of FIG. 2. FIG. 6 shows, at least, the recess 134 for the needle valve and piston insert, the vent 132 for the recess 134, the flange 137 for the preload spring, the fuel channels 122 leading to the inlet check valve (reed valve.) FIG. 6 shows the diameter 602 of the piston that is effective for pressurization. An average equivalent cylindrical pressurization chamber depth may be computed based on the pressurization chamber volume and the area associated with this diameter 602. In one exemplary variation, the diameter 602 may be 0.45 inch, 1.14 cm.

Figure 7A:
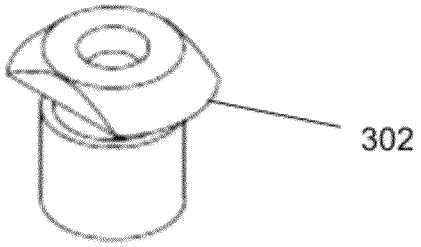
FIG. 7A and FIG. 7B illustrate the piston insert for the injector of FIG. 2.
Figure 7B:
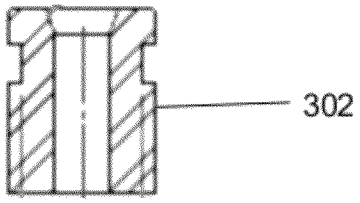

FIG. 7A and FIG. 7B illustrate an exemplary piston insert for the injector of FIG. 2. The piston insert has a center hole for guiding the needle component of the needle valve. The shoulder of the insert holds the input reed valve 104 in place. The piston insert may be press fit or threaded into the piston. FIG. 7A is a perspective view. FIG. 7B is a side cross section view.

Figure 8C:
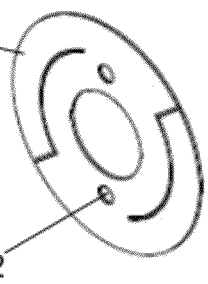
FIG. 8A-FIG. 8C illustrate an exemplary refill reed valve for the injector of FIG. 2.
Figure 8A:
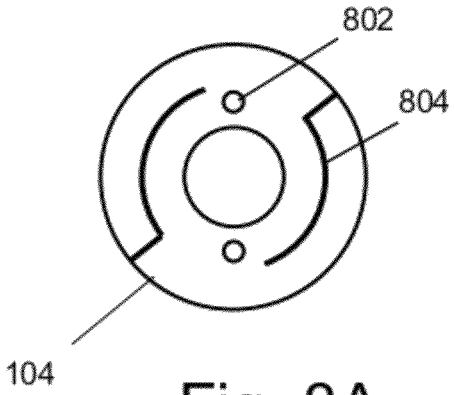
Figure 8B:
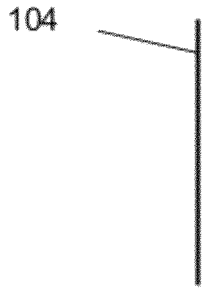

FIG. 8A-FIG. 8C illustrate an exemplary refill reed valve for the injector of FIG. 2. FIG. 8A is a top view. FIG. 8B is a side view. FIG. 8C is a perspective view. In one embodiment, the reed valve disk may be fabricated from a sheet of material, preferably spring steel. The diameter should preferably be close to the piston diameter, for example 0.445 in. The thickness should withstand the injection pressure, for example 0.005 in. Holes 802 for locating pins keep the reed valve in position. Slots 804 are cut to allow the operation of the reed valve. By retaining the uncut material in the disk, the valve disk occupies substantially the full volume in the 0.005 in thickness portion of the injection chamber, thereby preventing dead space which would otherwise be occupied by fuel, which is much more compressible than the spring material.

FIG. 9A-FIG. 9D illustrate an exemplary conical needle valve for the injector of FIG. 2. FIG. 9A is a side view. FIG. 9B is a cross section view. FIG. 9C is a top view. FIG. 9D is a perspective view. The stem 906 locates a spring for closing the valve. The slot 902 is for an O-ring seal. A conical tip 904 is shown in this variation.

FIG. 10A-FIG. 10D illustrate an exemplary spherical point needle valve for the injector of FIG. 2. FIG. 10A is a side view. FIG. 10B is a cross section view. FIG. 10C is a top view. FIG. 10D is a perspective view. The stem 906 locates a spring for closing the valve. The slot 902 is for an O-ring seal. A spherical tip 1002 is shown in this variation.

Figure 11:
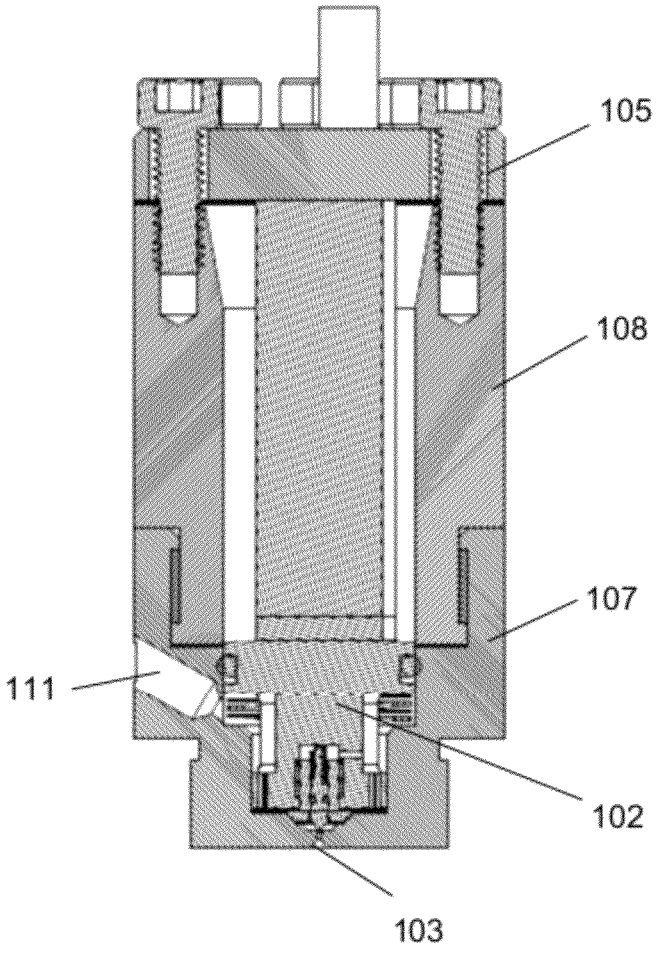
FIG. 11 illustrates a cross section view of an exemplary high pressure piezoelectric actuated impulse pump and fuel injector having a spherical point needle valve.

FIG. 11 illustrates a cross section view of an exemplary high pressure piezoelectric actuated impulse pump and fuel injector having a spherical point needle valve.

FIG. 12 illustrates a cross section view of an exemplary high pressure piezoelectric actuated impulse pump and fuel injector having a poppet valve.

FIG. 13 illustrates a closeup view of the piston and injection valve of FIG. 12. FIG. 13 also shows the locating rods 1306 for the reed valve shown in FIG. 8. The locating rods may also used in other fuel injector embodiments. The injector of FIG. 3A has a poppet valve 302 with a spring 304 return and support insert 306. The poppet valve 1204 also has conical valve surface and seat to produce a fine mist and direct the mist in a particular pattern. The valve stem 1204 has a conical surface mating with a conical seat 1202 in the housing 107. Compression spring 1302 keeps the stem seated and valve closed in normal conditions. High pressure fluid pushes the stem to open the valve. The valve is opened just sufficiently to release the desired fuel amount. The fuel is accelerated through the narrow passages at the valve exit to produce the fine mist injection. One advantage of the poppet valve embodiment is that combustion pressure tends to seat the valve and prevent leakage of gas into the injector. Note that the piston and insert may be modified to receive structures from the poppet assembly. The compression chamber feeds a valve chamber 1308 that is part of the compression chamber. The valve chamber should be a close fit to the valve components to minimize fuel volume to minimize compression losses from compressing the fuel. The valve chamber volume should preferably be less than 50% of the total compression chamber volume, and more preferably less than 20% of the total compression chamber volume.

Figure 14A:
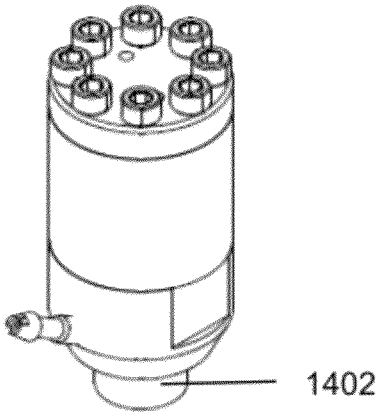
FIG. 14A-FIG. 14C illustrate an alternative fuel injector having a large conical expansion cone at the output of the injector nozzle.
Figure 14B:
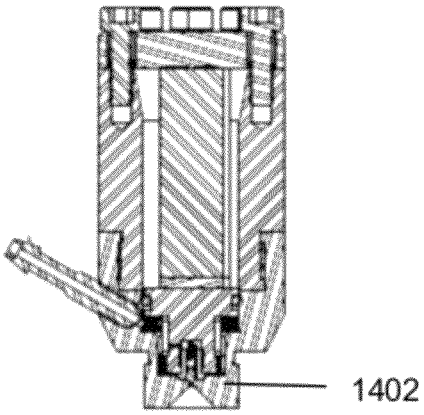
Figure 14C:
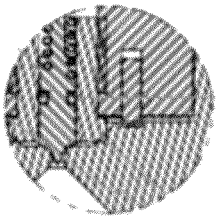

FIG. 14A-FIG. 14C illustrate an alternative fuel injector having a large conical expansion cone at the output of the injector nozzle. FIG. 14A shows a perspective view. FIG. 14B shows a side cross section view of the fuel injector of FIG. 14A. FIG. 14C shows a close up of the nozzle portion of FIG. 14B. The large conical expansion cone structure 1402 is shown.

Figure 15A:
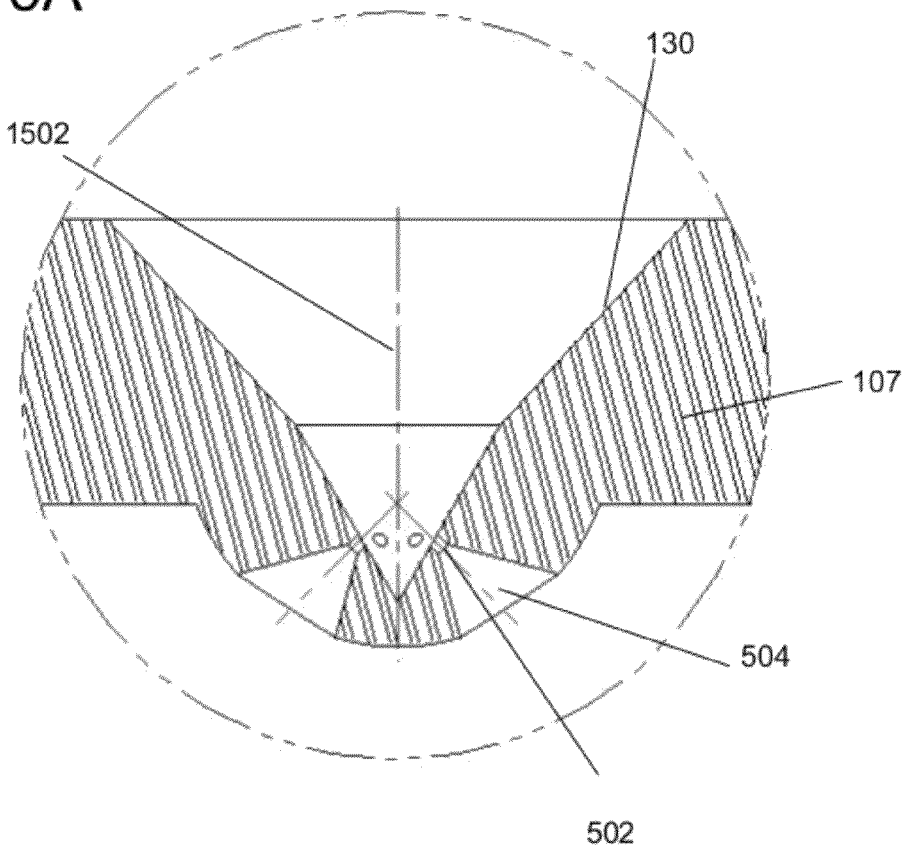
FIG. 15A and FIG. 15B show an exemplary valve seat and nozzle structure.
Figure 15B:
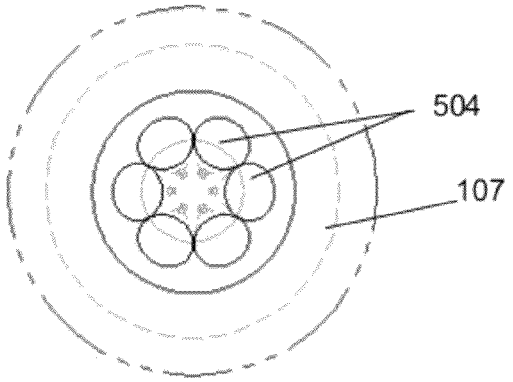

FIG. 15A and FIG. 15B show an exemplary valve seat and nozzle structure. FIG. 15A shows a cross section view. FIG. 15B shows a bottom view. The valve seat shown is a conical valve seat 130. The straight through hole variation as shown in FIG. 5 may also be used. The nozzle structure comprises, for example, six sets of holes 502 and associated expansion cones 130. The holes are arranged radially around a vertical center line 1502 at a predefined spray angle of, for example, 45 degrees with respect to the vertical center line. Any desired angle may be used.

Injection Pressure

The injection pressure is a primary sizing requirement for direct fuel injection (DFI) systems, as is injection volume. Given that the maximum actuation distance, $D_{xactuator}$, for a given actuator is fixed, the maximum injection pressure also is an inverse function of the maximum injection volume, $V_{max}$ due to the elasticity of the actuator.

$$p_{injector_actuator} = \frac{F_{actuator}}{A_{actuator}}$$

$$p_{injector_actuator} = \frac{F_{actuator}}{(V_{max} / \Delta x_{actuator})}$$

Figure 16:
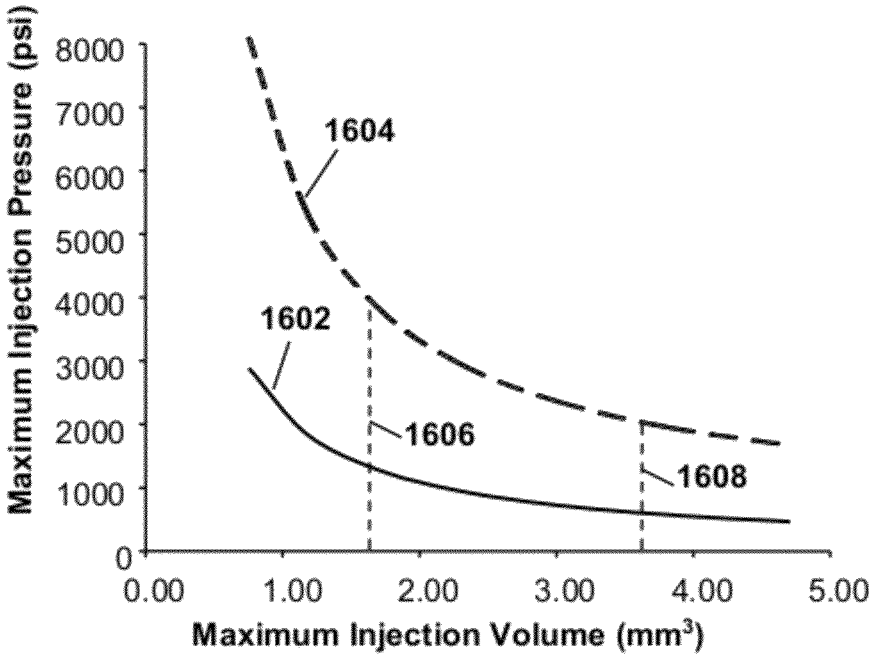
FIG. 16 shows the relationship between the maximum injection pressure and volume for exemplary fuel injectors in accordance with the present invention.

FIG. 16 shows the relationship between the maximum injection pressure and volume for exemplary fuel injectors in accordance with the present invention. Referring to FIG. 16, the solid line 1602 uses a commercially available piezoelectric actuator. The dashed line 1604 reflects a higher force actuator that is within the current technology limits. Injection volumes 1606 and 1608 represent two exemplary designs presently contemplated. While piezoelectric actuators are available that can produce even higher pressures, reducing the injection pressures minimizes the size of the actuator and eases performance tolerances.

The maximum injection pressure of the exemplary embodiment is 3000 psi. However, if needed, injection pressures could be increased to 4000 psi and potentially approach 10,000 psi. At such high pressure, the lower injection volume per injection may be compensated by scheduling multiple injections per engine revolution. The pressures shown in FIG. 16 are significantly greater than the 15-30 psi injection systems found in automotive port fuel injection systems and other small engine fuel injection systems. While piezoelectric actuators are available that can produce even higher pressures, the reduced injection pressure simplifies the design.

Figure 17:
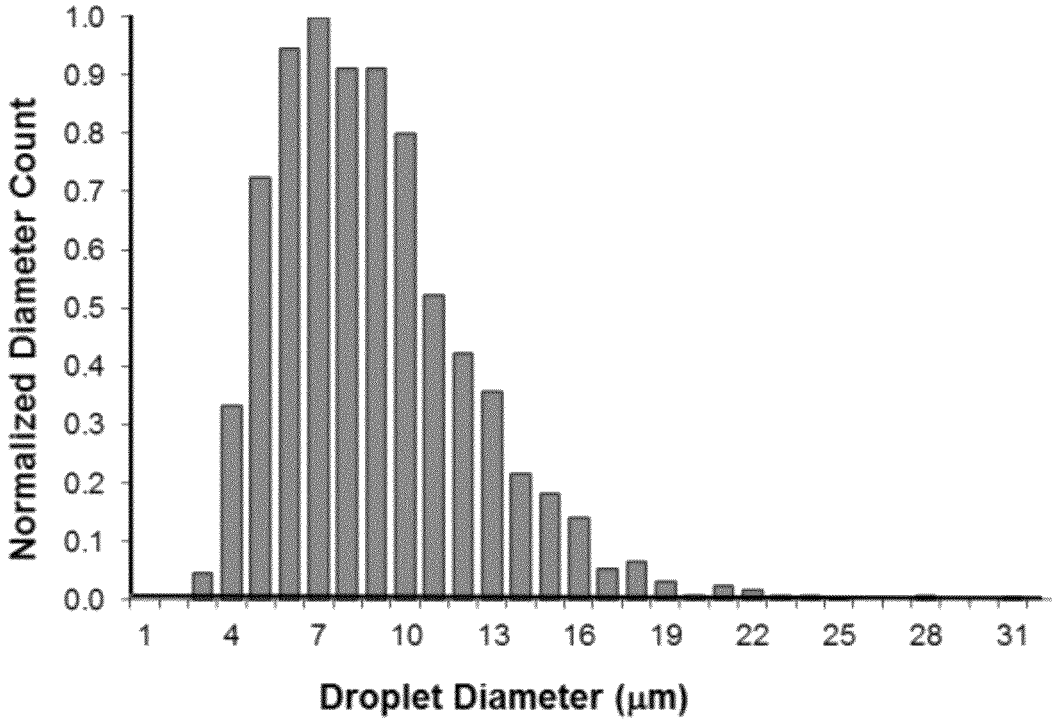
FIG. 17 shows droplet diameter distribution as measured from an exemplary fuel injector.

FIG. 17 shows droplet diameter distribution as measured from an exemplary fuel injector.

Figure 18:
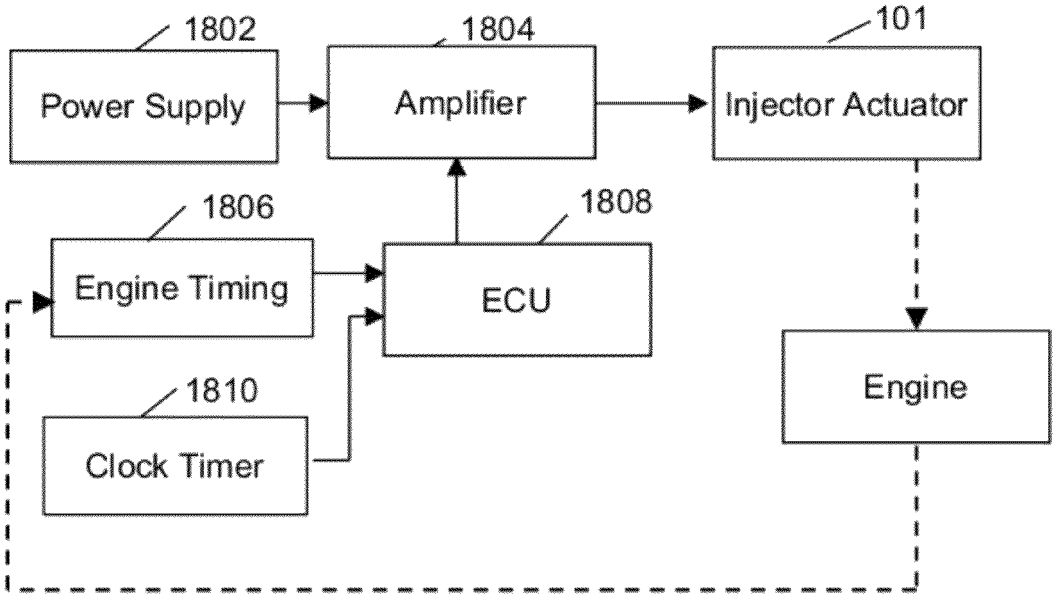
FIG. 18 is a block diagram representing an exemplary drive system for the injector of the present invention.

FIG. 18 is a block diagram representing an exemplary drive system for the injector of the present invention. Referring to FIG. 18, an electronic computer unit (ECU) 1808 receives timing information 1806 relating to crank shaft angle and stroke for each cylinder. The computer 1808 may use clock timing information 1810 to interpolate between crank shaft angle events and to develop RPM information as needed by a timing algorithm. The computer then calculates the desired pulse timing in accordance with the timing algorithm and generates a pulse waveform. The pulse waveform is then amplified by amplifier 1804 and delivered as a drive pulse to each injector actuator 101.

Figure 19:
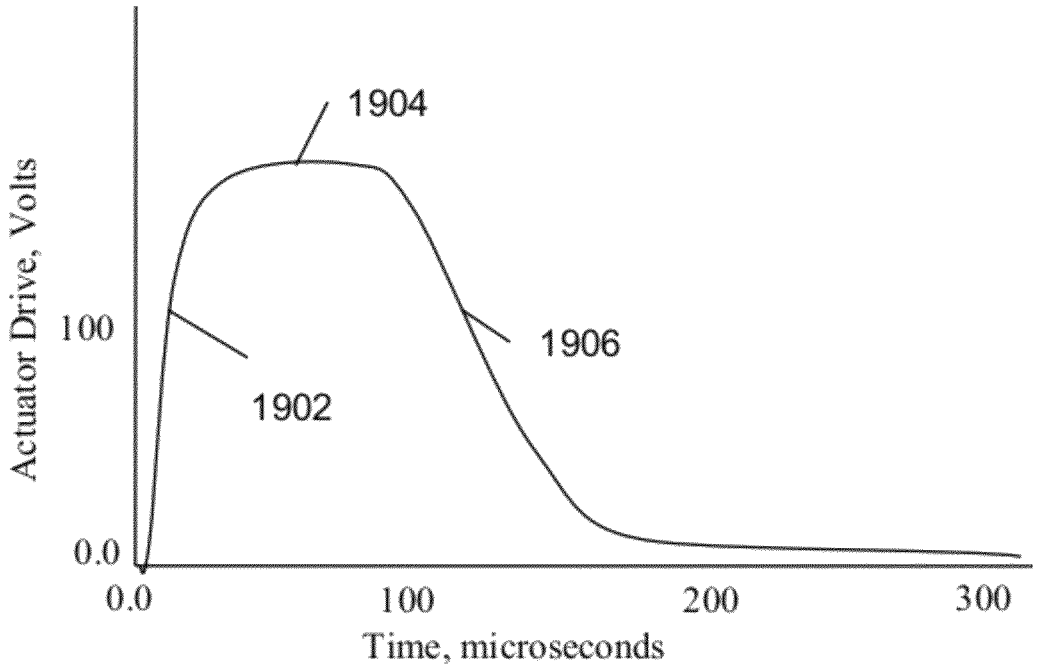
FIG. 19 illustrates an exemplary drive pulse for an actuator in accordance with the present invention.

FIG. 19 illustrates an exemplary drive pulse for an actuator in accordance with the present invention. Referring to FIG. 19, the drive pulse for a single injection comprises a positive pulse having a rising edge 1902, a peak hold period 1904, and a falling edge 1906. The rising edge 1902 has a rise time reflecting the time to achieve a percentage, for example 90% of the peak. The extension of the actuator 101 may follow the rising edge of the drive pulse with some delay according to the elasticity of the actuator and the mechanical load (including, among other things, the piston 102, pressurization chamber 112, and injection valve 104.) During the rising edge portion 1902, the actuator compresses the fuel and the injection valve opens. As the voltage approaches the peak, the rate of rise slows and gradually transitions to a steady level 1904 for a period of time. The actuator finishes extension during this time, and the fuel is injected. As fuel is injected, the pressure drops and the injection valve closes. The drive voltage then transitions to the falling edge 1906, during which the actuator contracts to the relaxation state, the input reed valve opens and fuel is admitted to the pressurization chamber. The falling edge 1906 may be slower than the rising edge 1902 and the transitions from rising edge to peak hold and from peak hold to falling edge may be rounded to reduce tension stress in the actuator. Alternatively, or in combination, the actuator may be constructed with a mechanical (spring loaded) compressive preload to reduce tension stress. The graph of FIG. 19 is somewhat idealistic to illustrate the principles. In practice, overshoots and ringing may be typically found in an actual voltage plot. The specific voltages and associated currents depend on the actuator design. An actuator may be fabricated of a stack of actuator components wired in parallel for a lower voltage, higher current embodiment. Typically the amount of fuel injected may be varied by varying the peak voltage of the drive pulse up to a maximum allowable for the actuator. If more fuel is needed, a larger actuator may be provided, or alternatively, multiple injections per stroke may be provided. The typical repetition rate is a function of the rotation rate of the engine. Typical small engines may run at 200 to 10,000 revolutions per minute (RPM) with one injection for each two revolutions for four stroke engines, one injection for each revolution for two stroke engines.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A high pressure fuel injector for direct injection of fuel into a cylinder of a compression ignition engine, said fuel injector comprising:

a housing;

a piston movable within a bore within said housing;

a piezoelectric actuator disposed within said housing, said piezoelectric actuator having a first end seated against said housing and a second end operatively coupled to said piston;

said housing comprising a cylinder head, said cylinder head and said piston forming a pressurization chamber therebetween;

a needle valve assembly comprising a needle component movable within a bore within said piston, said needle component spring loaded against said piston and seated within a needle valve seat; said needle valve seat disposed on said cylinder head across said pressurization chamber from said piston;

said housing having a fuel input port formed in said housing, said fuel input port configured for coupling said fuel at an input pressure at said input port through an input check valve to said pressurization chamber;

said pressurization chamber coupled to an injection nozzle through said needle valve assembly;

wherein during operation, the piezoelectric actuator drives the piston a displacement distance toward the cylinder head in response to an electrical input, generating a high pressure in the pressurization chamber, said high pressure higher than said input pressure; said high pressure coupled to said spring loaded needle component and said high pressure lifts said spring loaded needle component to open said needle valve assembly and allow a portion of high pressure fuel from said pressurization chamber to exit between the spring loaded needle component and the needle valve seat, delivering said portion of said high pressure fuel from said pressurization chamber through said needle valve assembly and said injection nozzle to said cylinder of said engine.

2. The fuel injector in accordance with claim 1, wherein an equivalent cylindrical depth of the pressurization chamber may be less than 1/10 of the diameter.

3. The fuel injector in accordance with claim 1, further including a reed valve component and a reed valve holder structure, wherein a cylinder head surface is conformal to a piston assembly comprising said piston, said reed valve component, and said reed valve holder structure; and said cylinder head surface is less than one millimeter from said piston assembly for at least 80% of the cylinder head surface.

4. The fuel injector in accordance with claim 1, wherein the fuel injector develops at least 69 Bars pressure and delivers less than three cubic millimeters of fuel per stroke at full power.

5. The fuel injector in accordance with claim 1, wherein the piston has a flange extending beyond an operative fluid pressurization diameter of said piston and said piston is preloaded against said piezoelectric element by at least one spring in operative contact with said flange.

6. The fuel injector in accordance with claim 1, wherein a cylinder, cylinder head and a injection valve seat, and injection nozzle orifice are fabricated in a single piece of material.

7. The fuel injector in accordance with claim 1, further including a reed clamp, wherein said input check valve is a reed valve held by said reed clamp, said reed clamp having a tapered edge extending into said pressurization chamber.

8. The fuel injector in accordance with claim 7, wherein the cylinder head forms a tapered recess tapered to match the taper of said reed clamp.

9. The fuel injector in accordance with claim 8, wherein the tapered edge of said reed clamp extends into said tapered recess in said cylinder head.

10. The fuel injector in accordance with claim 1, wherein, the pressurization chamber volume is capable of being configured for a volume such that compression of the fuel at a maximum pressure accounts for less than half of said piston displacement distance.

* * * * *